US005922987A

United States Patent [19]

Hoffman et al.

[11] Patent Number: 5,922,987

[45] Date of Patent: Jul. 13, 1999

[54] HYDRAULIC TRAVERSE AND ELEVATION MECHANISM

[75] Inventors: Kenneth J. Hoffman, Gilbert; Danny E. Neikes, Mesa; Don E. Van Osten, Gilbert, all of Ariz.

[73] Assignee: McDonnell Douglas Helicopter Co., Mesa, Ariz.

[21] Appl. No.: 08/862,736

[22] Filed: May 23, 1997

Related U.S. Application Data

[60] Provisional application No. 60/020,006, Jun. 18, 1996, abandoned.

[51] Int. Cl.[6] ..... F41A 25/04

[52] U.S. Cl. ..... 89/37.11; 89/41.12; 89/41.17

[58] Field of Search ..... 89/37.11, 41.12, 89/41.17, 41.22, 43.01, 43.02

[56] References Cited

U.S. PATENT DOCUMENTS

| | | | |
|---|---|---|---|
| 2,790,357 | 4/1957 | Garrett | 89/43.01 |
| 4,178,831 | 12/1979 | Tidemalm et al. | 89/41.12 |
| 4,890,537 | 1/1990 | Streit et al. | 89/37.11 |
| 5,663,521 | 9/1997 | Mandereau et al. | 89/43.01 |

FOREIGN PATENT DOCUMENTS

| | | | |
|---|---|---|---|
| 722757 | 7/1942 | Germany | 89/43.01 |

*Primary Examiner*—Stephen M. Johnson

*Attorney, Agent, or Firm*—Donald E. Stout; Kenton R. Mullins

[57] ABSTRACT

A locking mechanism for locking an orientation of a weapon is disclosed. The locking mechanism includes a first movable arm adapted to contact and apply pressure onto a control surface associated with the weapon, and a second movable arm adapted to contact and apply pressure onto the control surface associated with the weapon. The locking mechanism further includes a valve for applying and removing resistance to the first movable arm and the second movable arm, to thereby control a resistance to movement of the first movable arm and the second movable arm. The valve is adapted to remove resistance from the first movable arm and the second moveable arm in order to allow the weapon to be moved freely into a desired orientation. After the weapon is moved into the desired orientation, the valve may be moved again to increase resistance to thereby allow for fine adjustments in the orientation of the weapon. Finally, the valve may be completely closed to lock the orientation of the weapon. The first movable arm and the second movable arm each have separate hydraulic cylinders and pistons, and the valve couples the first hydraulic cylinder to the second hydraulic cylinder.

28 Claims, 2 Drawing Sheets

HYDRAULIC TRAVERSE AND ELEVATION MECHANISM

This application claims the benefit of U.S. Provisional Application No. 60/020,006, filed Jun. 18, 1996, now abandoned, the contents of which are expressly incorporated herein by reference.

BACKGROUND OF THE INVENTION

1. Field of the Invention

The present invention relates generally to machine gun mounts and, more particularly, to traverse and elevation mechanisms for machine gun mounts.

2. Description of Related Art

A machine gun fired from a tripod can be held in place by a mechanical device, which is commonly referred to as a traverse and elevation mechanism. A typical traverse and elevation design consists of a vertical arm of variable length which travels along a horizontal (traverse) bar. The mechanical linkage and components required for this type of mechanism subject the design to problems and limitations relating to functionality and performance. One purpose of a traverse and elevation mechanism is to hold the weapon steady in a position chosen by the gunner and to provide adjustments to the chosen position. Prior art traverse and elevation mechanisms generally suffer from poor target acquisition time, operational complexity, backlash, and loose parts.

Target acquisition time refers to the time required by a user to acquire a target. This time is typically slow because of the complex nature of operation required by conventional traverse and elevation mechanisms. Adjustments in weapon aiming position are restricted by the physical limits of the prior art mechanical traverse and elevation mechanisms. Coarse adjustments are only allowed in traverse, and are accomplished by physically moving the traverse and elevation mechanism on it's support bar. The use of both of a user's hands is required to first release a traverse and elevation mechanism clamp, simultaneously move both the weapon and the traverse and elevation mechanism to a desired configuration, and finally re-secure the clamp in the desired position, all of which can be cumbersome and time consuming in a battle situation.

Fine adjustments in both traverse and elevation are provided by movement of the traverse and elevation mechanism itself. Adjustments are made by rotating a detented knob which provides a preset amount of rotation between detents. Rotation of the adjustment knob is translated into small changes in traverse and/or elevation. The actual change in the traverse and elevation mechanism setting, by using the adjustment knob detents, may or may not provide the change in setting desired by the gunner. For example, a one detent change in azimuth may be too little and a second detent change may be too much. Also, clearances, commonly referred to as backlash, between the rotating elements of the adjusting mechanism can cause additional aiming errors.

Tolerances between the mechanical parts of traverse and elevation mechanisms introduces working clearances. These working clearances can permit small movements of the weapon which cause large errors in the impact area of the projectiles at extended ranges.

In summary, the problems with prior-art traverse and elevation mechanisms are as follows: (1) coarse adjustments require the use of both hands, are time consuming, and are allowed only in the traverse direction; (2) fine adjustments are sometimes not fine enough to point the weapon exactly at the desired target; and (3) clearances between the traverse and elevation mechanism parts introduce aiming errors and can allow for too much unintended movement of the weapon.

Regarding operational complexity, in many cases the operator must take his or her eyes off of the target and his or her hand off of the weapon to operate the traverse and elevation mechanism. Also, course adjustments and fine adjustments are entirely different procedures, which adds to the complexity of the task. In the case of a fine adjustment, it is possible to run out of fine adjustment travel, requiring the operator to make an additional course adjustment before acquiring the target.

Additionally, regarding the problem of backlash associated with prior art traverse and elevation mechanisms, because of the mechanical linkage involved, it is almost impossible to eliminate backlash from these systems. This phenomena can result in inaccuracy. It is therefore usually required that the operator bias the weapon in a certain direction when aiming and when firing. This limitation leads to inaccuracy. Further, prior art traverse and elevation systems generally comprise a number of loose parts. In most installations, when the weapon is removed from the traverse and elevation mechanism mount and the traverse and elevation mechanism mount is stored, the traverse and elevation mechanism is an extra or loose part. This arrangement can prove to be inconvenient in an infantry situation.

SUMMARY OF THE INVENTION

The hydraulic traverse and elevation mechanism of the present invention provides a reduction in both target acquisition time and operational complexity. A valve control can be gripped by a user to tailor the resistance of the hydraulic traverse and elevation mechanism. The resistance of the hydraulic traverse and elevation mechanism is variable from a free-gun state to a completely locked state, and can be tailored by the user.

The hydraulic traverse and elevation mechanism of the present invention utilizes a point-and-shoot principle of operation, which is simple and which can be implemented with a single control. Elevation and traverse can be controlled independently, if required. Since operational complexity is reduced, the hydraulic traverse and elevation mechanism allows the operator to concentrate on the conditions of the battle field.

Target acquisition time is reduced through the use of a single valve for facilitating both quick coarse adjustment and controlled dampened fine adjustment. The point-and-shoot feature of the present invention implements an important element of human engineering, which facilitates quick and accurate acquisition of targets by the user. The user can directly control the position of the weapon, for example, by simply grabbing the handles of the weapon and pointing the weapon. By using the variable resistance feature of the present invention, the operator can acquire the general target area with a quick, low resistance motion and then increase the resistance and bring the weapon to the target point with a slower, dampened, and easy to control movement. The operator can then lock the weapon on the point of aim. The hydraulic traverse and elevation mechanism of the present invention facilitates infinitesimally small movements for correcting weapon aiming, which is an improvement over the relatively large quick movements of prior art traverse and elevation mechanisms.

The hydraulic traverse and elevation mechanism of the present invention further reduces or eliminates backlash, and does not require a number of loose parts. More particularly, the hydraulic traverse and elevation mechanism of the present invention "spring loads" the mounting system. This spring loading virtually eliminates backlash, regardless of manufacturing tolerances, and thereby increases the accuracy of the system. Use of a spring loaded accumulator, according to the present invention, eliminates the negative affects of design clearances and manufacturing tolerances. The hydraulic traverse and elevation mechanism of the present invention does not require any loose parts, since the hydraulic traverse and elevation mechanism of the present invention is designed as an integrated assembly. Consequently, extra or loose parts are not prevalent when the weapon and mount are disassembled.

According to one aspect of the present invention, a locking mechanism for locking an orientation of a weapon is disclosed. The locking mechanism includes a first movable arm adapted to contact and apply pressure onto a control surface associated with the weapon, and a second movable arm adapted to contact and apply pressure onto the control surface associated with the weapon. The locking mechanism further includes a valve for applying and removing resistance to the first movable arm and the second movable arm, to thereby control a resistance to movement of the first movable arm and the second movable arm. The valve is adapted to remove resistance from the first movable arm and the second moveable arm in order to allow the weapon to be moved freely into a desired orientation. After the weapon is moved into the desired orientation, the valve may be moved again to increase resistance, to thereby allow for fine adjustments in the orientation of the weapon. Finally, the valve can be completely closed to lock the orientation of the weapon. The first movable arm and the second movable arm each have separate hydraulic cylinders and pistons, and the valve couples the first hydraulic cylinder to the second hydraulic cylinder.

The present invention, together with additional features and advantages thereof, may best be understood by reference to the following description taken in connection with the accompanying illustrative drawings.

DETAILED DESCRIPTION OF THE PRESENTLY PREFERRED EMBODIMENT

Figure 1:
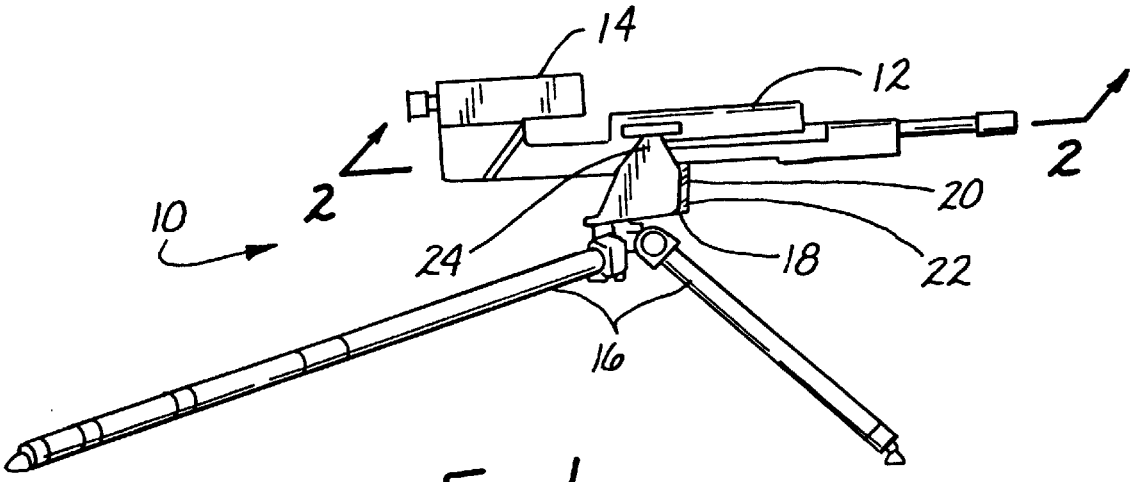
FIG. 1 is a side-elevational view of a hydraulic traverse and elevation mechanism, used in combination with a weapon, according to the presently preferred embodiment.

Referring more particularly to the drawings, a weapons system 10 is illustrated in FIG. 1 comprising a weapon 12 and a scope 14. The weapon 12 is supported by support legs 16 via a yolk 18. The yolk 18 comprises a first support member 20 and a second support member 22. A pivot 24 is disposed between the first support member 20 and the second support member 22 of the yolk 18.

Figure 2:
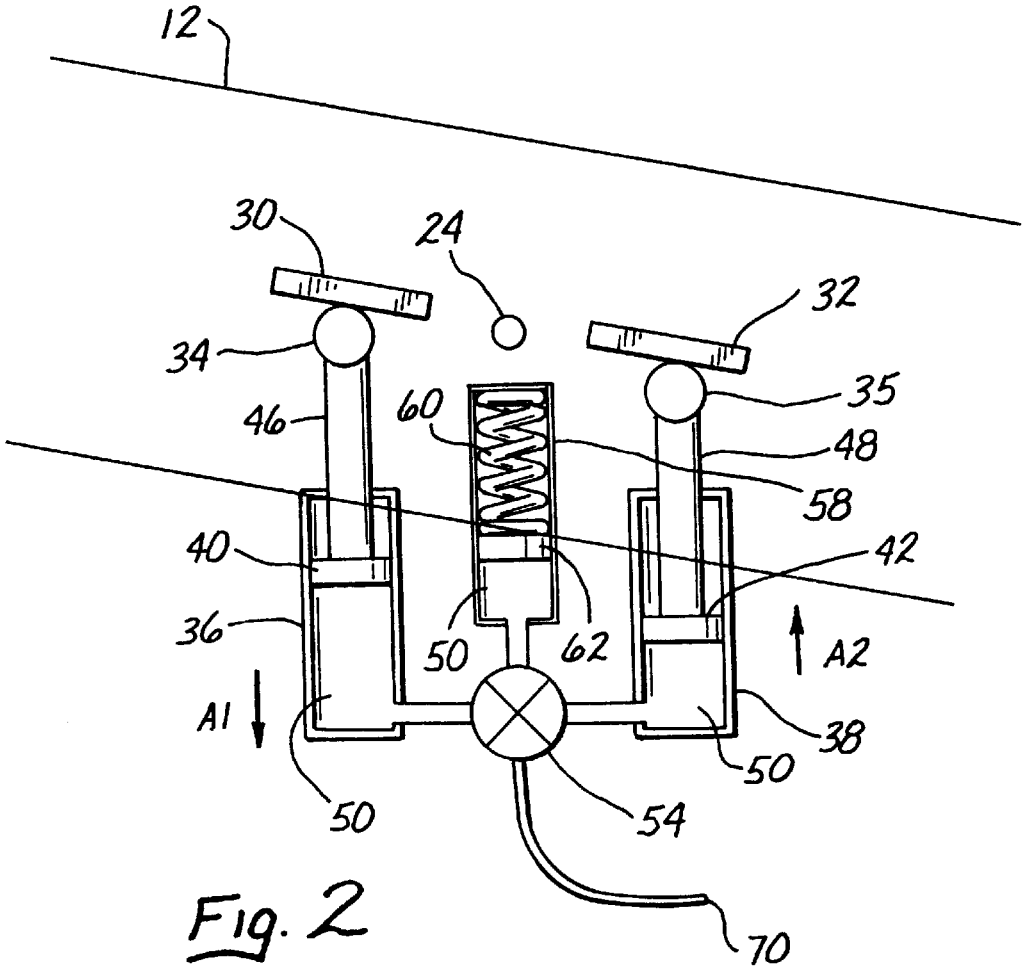
FIG. 2 illustrates a side cross-sectional view of the hydraulic traverse and elevation mechanism of the presently preferred embodiment.

FIG. 2 illustrates a schematic cross-sectional view taken along the line 2—2 of FIG. 1. The weapon 12 comprises a first control surface 30 and a second control surface 32. The first control surface 30 and the second control surface 32 may be attached to or integrally formed on the side of the weapon 12. Alternatively, the first and second control surfaces 30, 32 may be attached or formed beneath the weapon 12. The first and second control surfaces 30 and 32 accommodate first and second rollers 34 and 35, respectively, of the hydraulic traverse and elevation mechanism of the presently preferred embodiment. The hydraulic traverse and elevation mechanism of the present invention comprises a first elevation hydraulic cylinder 36 and a second elevation hydraulic cylinder 38. The first elevation hydraulic cylinder 36 and the second elevation hydraulic cylinder 38 accommodate a first piston 40 and a second piston 42, respectively. The first piston 40 is connected to the first roller 34 via a first arm 46, and the second piston 42 is connected to the second roller 35 via a second arm 48.

As presently embodied, a hydraulic fluid 50 is disposed within portions of the first elevation hydraulic cylinder 36 and the second elevation hydraulic cylinder 38, and a valve 54 is disposed between the first elevation hydraulic cylinder 36 and the second elevation hydraulic cylinder 38. The valve 54 connects the first elevation hydraulic cylinder 36 and the second elevation hydraulic cylinder 38 to an accumulator 58. The accumulator 58 comprises a spring 60 and a piston 62. Hydraulic fluid 50 is compressed by the piston 62, under pressure exerted by the spring 60.

The hydraulic traverse and elevation mechanism preferably operates on a principle of substantially incompressible hydraulic fluid 50. The first elevation hydraulic cylinder 36 and the second elevation hydraulic cylinder 38 are counter-opposing, so that when one cylinder is moved in a first direction the other cylinder is moved in an opposite direction. When the weapon 12 is moved by a user, for example, one of the first and second control surfaces 30, 32 contacts a corresponding one of the first and second rollers 34, 35, and forces a corresponding one of the first and second pistons 40, 42 downwardly in a direction of the arrow A1. The downward movement of the piston displaces hydraulic fluid 50 in the corresponding cylinder through the valve 54 and into the other cylinder, causing the piston in the other cylinder to move upwardly in a direction of the arrow A2. For example, if the first piston 40 were moved in the direction of the arrow A1, this movement would result in an opposing movement of the second piston 42 in the direction of the arrow A2, when the valve 54 is not completely shut. The first elevation hydraulic cylinder 36 and the second elevation hydraulic cylinder 38 are preferably mounted at equal distances from the pivot 24 so that the linear movements of the first and second pistons 40, 42 will be approximately equal in magnitude. This equal spacing of the first and second pistons 40, 42 from the pivot 24 maintains each of the first and second rollers 34, 35 in contact with the first and second control surfaces 30, 32 during movement of the first and second pistons 40, 42, respectively.

As the valve 54 is closed by movement of the control arm 70, increased resistance is generated to the flow of hydraulic fluid 50 between the first elevation hydraulic cylinder 36 and the second elevation hydraulic cylinder 38. This increased resistance to the flow of hydraulic fluid 50 results in increased resistance to movement of the weapon 12 about the pivot 24. When the valve 54 is completely closed, the weapon 12 is locked in place, since the first and second hydraulic cylinders 36, 38 are in contact with their respective first and second control surfaces 30, 32 and the hydraulic fluid 50 in these cylinders is incompressible.

The valve 54 also opens and closes a fluid path to the accumulator 58. As the valve 54 is opened and closed between the first elevation hydraulic cylinder 36 and the second elevation hydraulic cylinder 38, for example, access to the accumulator 58 is also opened and closed. The accumulator 58 "spring-loads" the hydraulic traverse and elevation system by supplying pressurized hydraulic fluid via the piston 62 and spring 60. This pressure supplied by the fluid within the accumulator 58 forces the first and second rollers 34, 35 against the first and second control surfaces 30, 32, respectively. Consequently, hysteresis or backlash is removed from the traverse and elevation mechanism of the present invention, regardless of manufacturing tolerances. The accumulator 58 further provides volume for fluid expansion during temperature changes in the environment, to thereby prevent fluid leakage through the seals of the system, for example.

Figure 3:
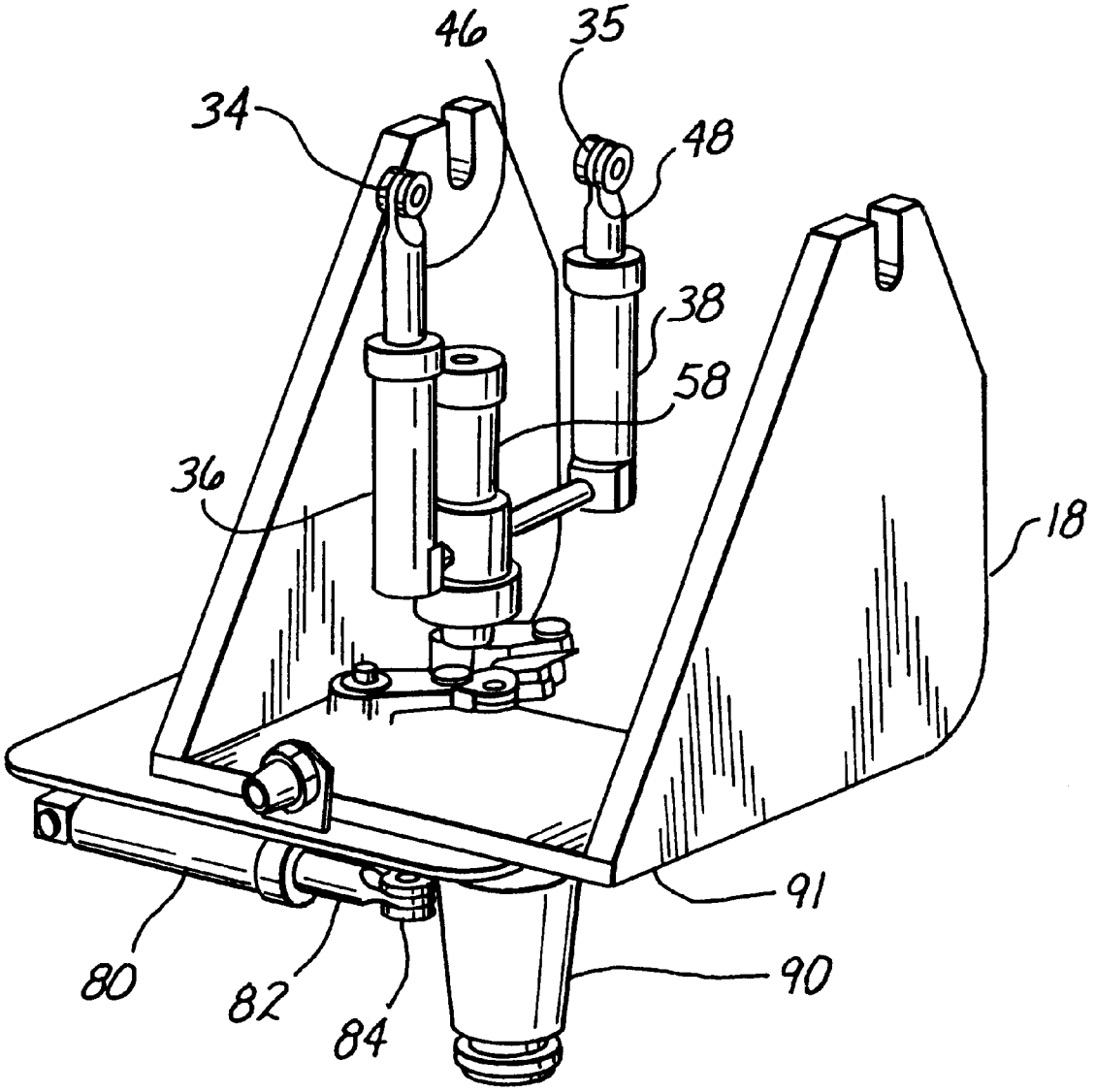
FIG. 3 illustrates a perspective view of the hydraulic traverse and elevation mechanism of the presently preferred embodiment.

FIG. 3 illustrates a perspective view of the hydraulic traverse and elevation mechanism of the presently preferred embodiment. A first traverse hydraulic cylinder 80 and a second traverse hydraulic cylinder (not shown) are disposed beneath the yolk 18. The first and second traverse hydraulic cylinders comprise a traverse mechanism, which also includes a traverse accumulator (not shown) and a traverse valve (not shown) similar to the accumulator 50 and the valve 54 of FIG. 2. The traverse mechanism generally operates in a manner similar to the elevation mechanism of FIG. 2. The first traverse hydraulic cylinder 80 comprises a first traverse arm 82 and a first traverse roller 84 for contacting a control surface, and the second traverse hydraulic cylinder comprises similar corresponding structure.

As the weapon 12 is rotated in a traverse direction about the pintle 90, one of the two traverse arms is moved into a corresponding hydraulic cylinder and the other traverse arm is moved out of the other corresponding traverse hydraulic cylinder. Opening and closing of the traverse valve by a traverse control arm (not shown) adjusts a resistance of the two traverse arms within the corresponding traverse hydraulic cylinders. In the presently preferred embodiment, first elevation hydraulic cylinder 36 and the second elevation hydraulic cylinder 38 are attached to the yolk 18, and the first and second control surfaces 30, 32 are attached to the weapon. Similarly, as presently embodied, the two traverse hydraulic cylinders are attached to the yolk 18 (or the weapon), and two traverse control surfaces are attached to the weapon mount.

The control arm 70 (FIG. 2) may be configured to control both the elevation mechanism of FIG. 2 and the traverse mechanism shown at the bottom of FIG. 3 or, alternatively, the traverse mechanism shown at the bottom of FIG. 3 may comprise a separate traverse control arm. The single control arm 70 of FIG. 2, for example, allows the operator to easily adjust the resistance of the hydraulic cylinders with only a single hand while keeping the users eyes on the target. The total angular range of the traverse and elevation mechanism in either plane is limited by the stroke of the pistons and their distance from the pivot point. This range can be increased, for example, by increasing the stroke of the piston.

One exemplary implementation of the hydraulic traverse and elevation mechanism of the present invention is now described to illustrate the ability of the hydraulic traverse and elevation mechanism to withstand adverse loading conditions. First and second hydraulic elevation hydraulic cylinders 36, 38 are located 1.5 inches apart from the pivot 24, and each of the first and second pistons 40, 42 is one inch in diameter. The barrel of the weapon 12 extends 3 feet beyond the pivot 24. The force required to subject the hydraulic traverse and elevation system to a pressure greater than 10,000 pounds per square inch (psi) is approximately 530 pounds, applied at the very tip of the barrel. A pressure of 10,000 psi in intermittent loading is well within the capacity of standard hydraulic components. If the weapon 12 is mounted away from the elevation or traverse pivot, this will also cause pressure loading to the system. This pressure loading would be much less than a rough handling load, such as the one just described. For example, a McDonnell Douglas Mk19 weapon, which has a recoil force of approximately 500 pounds, can be mounted 6 inches from the pivot center and still only induce a pressure of approximately 2,500 psi.

As an alternative to the hydraulic fluid 50, synthetic fluids which are less sensitive to temperature change (regarding viscosity, for example) can be used with the present invention to insure that there will be minimal change in the "feel" of the system over wide ranges of temperature. In any event, as presently embodied, volume changes due to severe temperatures are compensated for by the accumulator 58. Sand and dust have little effect on the hydraulic traverse and elevation mechanism of the present invention, since moving parts are contained internally. The system of the present invention requires sealing only at the piston shafts.

The hydraulic traverse and elevation mechanism of the present invention is preferably used in conjunction with modern site technology, including laser range finders and micro-processors for calculating ballistic solutions. With this modern technology, a compatible hydraulic traverse and elevation mechanism can more fully utilize the capabilities of modern sites and simplify the task of the operator. If a valve/accumulator is provided for each pair of cylinders, elevation and traverse can be controlled separately. This configuration lends itself to traditional tactics (range cards) currently employed. Calibrated markings on the weapon 12 and yolk 18 can indicate current elevation and traverse settings. In addition to the McDonnell Douglas Mk19, the McDonnell Douglas M2 machine gun is also a contemplated candidate for the present invention. These mounted weapon systems are likely to be used at longer ranges where accuracy is critical, and can be adapted to accommodate the present invention with minimal retrofitting. More particularly, control surfaces can be added to the weapon body and to the mount being used to accommodate the hydraulic traverse and elevation mechanism of the present invention. Smaller weapons can also benefit from the present invention, as well as other weapons. Additionally, the present invention may be used with other systems, such as telescope mounts and camera mounts.

The weapon mount may comprise a tripod mount for supporting the weapon 12 above a surface, or may comprise a plate mount for attaching the weapon 12 to a vehicle, for example. In either case, as presently embodied, the weapon mount comprises a planar surface having an aperture. The aperture is sized and configured to receive the pintle 90 of the yoke 18. When the pintle 90 is inserted into the aperture, the planar surface of the weapon mount faces upwardly to and lies in a plane generally parallel to a plane formed by a bottom surface 91 of the yoke 18. The planar surface of the weapon mount and the bottom surface 91 of the yoke 18 are spaced apart to form a gap, which accommodates the first traverse hydraulic cylinder 80 and the second traverse hydraulic cylinder.

The two traverse control surfaces are preferably disposed on the planar surface of the weapon mount, to thereby contact the first traverse roller 84 and a second traverse roller when the pintle 90 is inserted into the aperture. The two traverse control surfaces may comprise rectangular blocks, for example. The combination of the first and second traverse hydraulic cylinders and the two traverse control surfaces facilitates only a limited range of motion or angle of traverse. This angle of traverse can be increased or decreased by changing the location of the two traverse control surfaces and/or by changing the configuration and orientation of the first and second traverse hydraulic cylinders. In one embodiment, the rectangular blocks forming the two traverse control surfaces can be retracted into the planar surface by a user, to thereby permit the weapon 12 and the yoke 18 to move through an entire 360 degree angle of traverse.

According to an alternative embodiment of the elevation mechanism, the pivot 24 comprises a cam-shaped head, or a circular head that is off-axis to the pivot 24. The cam-shaped head of the pivot 24 is located on the exterior of the weapon 12 generally in the vicinity of the reference numeral 24 in FIG. 2. The cam-shaped head is used to drive the first and second rollers 34, 35. Since the cam serves as the first and second control surfaces 30, 32, the first and second control surfaces 30, 32 are omitted. Additionally, the first and second hydraulic cylinders 36, 38 (and the first and second arms 46, 48) are oriented to place the first and second rollers 34 and 35 into contact with the cam-shaped head. A preferred implementation of this alternative embodiment would orientate the first and second rollers 34 and 35 along a single axis, which is disposed generally on the exterior of the weapon 12 and which intersects the pivot 24. Since the alternative embodiment uses only the cam-shaped head of the pivot 24 to move the first and second traverse rollers, as the pivot 24 is rotated with vertical movement of the weapon, the first and second hydraulic cylinders 36, 38 may be constructed of a relatively small size.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

We claim:

1. A hydraulic mechanism for allowing movement of a weapon and for fixing an orientation of the weapon, the hydraulic mechanism comprising:

a first hydraulic cylinder;

a first piston disposed within the first hydraulic cylinder a first arm having a proximal end connected to the first piston and a distal end which is adapted to contact a first control surface of the weapon;

a second hydraulic cylinder;

a second piston disposed within the second hydraulic cylinder;

a second arm having a proximal end connected to the second piston and a distal end which is adapted to contact a second control surface of the weapon, the second hydraulic cylinder being fluidly connected to the first hydraulic cylinder;

a valve disposed between the first hydraulic cylinder and the second hydraulic cylinder, the valve facilitating a flow of fluid between the first hydraulic cylinder and the second hydraulic cylinder in an open position, and blocking a flow of fluid between the first hydraulic cylinder and the second hydraulic cylinder in a closed position;

whereby fluid passing between the first hydraulic cylinder and the second hydraulic cylinder facilitates movement of the weapon; and whereby the valve in the closed position prevents fluid from passing between the first hydraulic cylinder and the second hydraulic cylinder to thereby prevent movement of the weapon.

2. The hydraulic mechanism as recited in claim 1, further comprising hydraulic fluid disposed within the first hydraulic cylinder and the second hydraulic cylinder.

3. The hydraulic mechanism as recited in claim 2, wherein:

the distal end of the first arm comprises a first roller which is adapted to contact and roll along the first control surface of the weapon; and the distal end of the second arm comprises a second roller which is adapted to contact and roll along the second control surface of the weapon.

4. The hydraulic mechanism as recited in claim 2, wherein:

the first arm is biased to contact the weapon; and the second arm is biased to contact the weapon.

5. The hydraulic mechanism as recited in claim 4, further comprising:

an accumulator having a reservoir with additional hydraulic fluid therein, the reservoir being fluidly connected to the valve.

6. The hydraulic mechanism as recited in claim 5, whereby:

the hydraulic fluid within the reservoir is placed into fluid communication with both the first hydraulic cylinder and the second hydraulic cylinder when the valve is in the open position; and the hydraulic fluid within the reservoir is placed out of fluid communication with both the first hydraulic cylinder and the second hydraulic cylinder when the valve is in the closed position.

7. The hydraulic mechanism as recited in claim 6, further comprising:

means for pressurizing the hydraulic fluid in the accumulator to a pressure, which is greater than a hydraulic pressure in each of the first hydraulic cylinder and the second hydraulic cylinder.

8. The hydraulic mechanism as recited in claim 7, the means for pressurizing the hydraulic fluid in the accumulator comprising:

a piston fitting within the accumulator; and a spring biasing the piston against the hydraulic fluid in the accumulator, the piston pressing against the hydraulic fluid in the accumulator to thereby maintain the hydraulic fluid at a pressure, which is greater than a hydraulic pressure in each of the first hydraulic cylinder and the second hydraulic cylinder.

9. A hydraulic positioning system, comprising:

two arms adapted to contact and apply force to two corresponding control surfaces associated with a weapon;

a hydraulic system operatively connected to the two arms, the hydraulic system being adapted to hydraulically control pivotal movement of the two arms, the hydraulic system hydraulically controlling pivotal movement of the weapon about a pivot axis of the weapon when the two arms are placed into contact with the control surfaces, the control surfaces being disposed on opposite sides of the pivot axis of the weapon; and a valve coupled to the hydraulic system, the valve being movable between an open configuration where the hydraulic system allows the two arms to move with relatively little resistance, and a closed configuration where the hydraulic system prevents the two arms from moving.

10. The hydraulic positioning system as recited in claim 9, the valve allowing the hydraulic system to apply a range of resistances to the two arms, whereby the open configuration facilitates a free-gun state wherein a user can make course movements of the weapon, and whereby an intermediate configuration of the valve, between the open configuration and the closed configuration, facilitates a fine-adjustment state wherein a user can make fine movements of the weapon.

11. A hydraulic mechanism for allowing movement of a weapon and for fixing an orientation of the weapon, the weapon having a first control surface and a second control surface, the fixing mechanism comprising:

a first movable arm adapted to contact and apply pressure onto the first control surface of the weapon;

a second movable arm adapted to contact and apply pressure onto the second control surface of the weapon; and controlling means for controlling a movement of both the first movable arm and the second movable arm;

wherein the first movable arm and the second movable arm move in a reciprocal manner when the first movable arm contacts the first control surface and the second movable arm contacts the second control surface.

12. The hydraulic mechanism as recited in claim 11, wherein the controlling means comprises:

fixing means for fixing the movement of both the first movable arm and the second movable arm, to thereby fix an orientation of the weapon.

13. The hydraulic mechanism as recited in claim 12, the fixing means being configurable into an active configuration wherein movement of the first movable arm and the second movable arm is prohibited, and an inactive configuration wherein the first movable arm and the second movable arm are not fixed and the weapon can be moved.

14. The hydraulic mechanism as recited in claim 13, the controlling means comprising:

a first hydraulic cylinder;

a first piston disposed within the first hydraulic cylinder, the first movable arm having a proximal end connected to the first piston and a distal end which is adapted to contact the first control surface of the weapon;

a second hydraulic cylinder;

a second piston disposed within the second hydraulic cylinder, the second movable arm having a proximal end connected to the second piston and a distal end which is adapted to contact the second control surface of the weapon, the second hydraulic cylinder being fluidly connected to the first hydraulic cylinder; and a valve disposed between the first hydraulic cylinder and the second hydraulic cylinder, the valve facilitating a flow of fluid between the first hydraulic cylinder and the second hydraulic cylinder in an open position, and blocking a flow of fluid between the first hydraulic cylinder and the second hydraulic cylinder in a closed position.

15. The hydraulic mechanism as recited in claim 14, the hydraulic mechanism further comprising an accumulator having a reservoir with additional hydraulic fluid therein, the reservoir being fluidly connected to the valve.

16. The hydraulic mechanism as recited in claim 15, whereby:

the hydraulic fluid within the reservoir is placed into fluid communication with both the first hydraulic cylinder and the second hydraulic cylinder when the valve is in the open position; and the hydraulic fluid within the reservoir is placed out of fluid communication with both the first hydraulic cylinder and the second hydraulic cylinder when the valve is in the closed position.

17. The hydraulic mechanism as recited in claim 16, the hydraulic mechanism further comprising:

a piston fitting within the accumulator; and a spring biasing the piston against the hydraulic fluid within the accumulator, the piston pressing against the hydraulic fluid within the accumulator to thereby maintain the hydraulic fluid at a pressure, which is greater than a hydraulic pressure in each of the first hydraulic cylinder and the second hydraulic cylinder.

18. A locking mechanism for locking an orientation of a weapon, the locking mechanism comprising:

a first movable arm adapted to contact and apply pressure onto a control surface associated with the weapon;

a second movable arm adapted to contact and apply pressure onto the control surface associated with the weapon; and means for applying and removing resistance to the first movable arm and the second movable arm, to thereby control a movement of both the first movable arm and the second movable arm, the means for applying and removing resistance being adapted to remove resistance from the first movable arm and the second movable arm to thereby allow the weapon to be moved into a desired orientation, and the means for applying and removing resistance being adapted to apply resistance to the first movable arm and the second movable arm to thereby fix the weapon at a desired orientation.

19. The locking mechanism as recited in claim 18, the means for applying and removing resistance being adapted to apply and remove a substantially continuous range of different resistances to both the first movable arm and the second movable arm.

20. The locking mechanism as recited in claim 18, the first movable arm and the second movable arm being hydraulically connected so that an extension of one of the arms results in a shortening of the other arm.

21. The locking mechanism as recited in claim 20, the means for applying and removing resistance comprising a valve which is movable between an open configuration wherein hydraulic fluid can flow between a first reservoir associated with the first movable arm and a second reservoir associated with the second movable arm, and a closed configuration wherein hydraulic fluid cannot flow between the first reservoir and the second reservoir.

22. The locking mechanism as recited in claim 21, the valve further being movable between intermediate positions between the open configuration and the closed configuration, whereby resistance is progressively added to movement of the first movable arm and the second movable arm as the valve is progressively moved from the open configuration to the closed configuration.

23. A fixing mechanism for allowing movement of a weapon and for fixing an orientation of the weapon, the weapon having a first control surface and a second control surface, the fixing mechanism comprising:

a first movable arm adapted to contact and apply pressure onto the first control surface of the weapon;

a first hydraulic cylinder;

a first piston disposed within the first hydraulic cylinder, the first movable arm having a proximal end connected to the first piston and a distal end which is adapted to contact the first control surface of the weapon;

a second movable arm adapted to contact and apply pressure onto the second control surface of the weapon;

a second hydraulic cylinder;

a second piston disposed within the second hydraulic cylinder, the second movable arm having a proximal end connected to the second piston and a distal end which is adapted to contact the second control surface of the weapon, the second hydraulic cylinder being fluidly connected to the first hydraulic cylinder; and a valve disposed between the first hydraulic cylinder and the second hydraulic cylinder, the valve facilitating a flow of fluid between the first hydraulic cylinder and the second hydraulic cylinder in an open position, and blocking a flow of fluid between the first hydraulic cylinder and the second hydraulic cylinder in a closed position, whereby the valve is adapted to control a movement of both the first movable arm and the second movable arm.

24. The fixing mechanism as recited in claim 23, wherein:

the valve is adapted to fix the movement of both the first movable arm and the second movable arm, to thereby fix an orientation of the weapon, when the valve is in the closed position.

25. The fixing mechanism as recited in claim 24, wherein:

the valve in the open position allows movement of the first movable arm and the second movable arm; and the valve in the closed position prevents movement of the first movable arm and the second movable arm.

26. The fixing mechanism as recited in claim 25, the fixing mechanism further comprising an accumulator having a reservoir with additional hydraulic fluid therein, the reservoir being fluidly connected to the valve.

27. The fixing mechanism as recited in claim 26, whereby:

the hydraulic fluid within the reservoir is placed into fluid communication with both the first hydraulic cylinder and the second hydraulic cylinder when the valve is in the open position; and the hydraulic fluid within the reservoir is placed out of fluid communication with both the first hydraulic cylinder and the second hydraulic cylinder when the valve is in the closed position.

28. The fixing mechanism as recited in claim 27, the fixing mechanism further comprising:

a piston fitting within the accumulator; and a spring biasing the piston against the hydraulic fluid within the accumulator, the piston pressing against the hydraulic fluid within the accumulator to thereby maintain the hydraulic fluid at a pressure, which is greater than a hydraulic pressure in each of the first hydraulic cylinder and the second hydraulic cylinder.

* * * * *